US005827369A

United States Patent [19]

Tobari et al.

[11] Patent Number: 5,827,369

[45] Date of Patent: Oct. 27, 1998

[54] COATING APPARATUS

[75] Inventors: Junichi Tobari; Takeshi Kishido, both of Hino, Japan

[73] Assignee: Konica Corporation, Japan

[21] Appl. No.: 660,286

[22] Filed: Jun. 7, 1996

[30] Foreign Application Priority Data

Jun. 12, 1995 [JP] Japan ..... 7-144499

[51] Int. Cl.[6] ..... B05C 3/02

[52] U.S. Cl. ..... 118/410; 118/419

[58] Field of Search ..... 118/410, 411, 118/419

*Primary Examiner*—Brenda A. Lamb

*Attorney, Agent, or Firm*—Jordan B. Bierman; Bierman, Muserlian and Lucas

[57] ABSTRACT

Disclosed is a coating die for coating a web with a solution, wherein the web is conveyed in a predetermined direction so as to run in the vicinity of the coating die; comprising;

a body forming the coating die, a coating surface provided on the body at a position close to the running web;

a solution chamber provided in the body;

a feeding conduit provided in the body, wherein the solution is fed from the outside of the body to the solution chamber through the feeding conduit;

a slit provided in the body so as to connect the solution chamber and the coating surface, wherein the solution is fed from the solution chamber to the coating surface through the slit, and then the solution is transferred from the coating surface to the running web;

a dry surface provided on the body and positioned upstream of the coating surface in terms of the web-running direction; and a polymer layer formed on at least one of (1) the dry surface, (2) an internal surface of the slit, and (3) internal surfaces of the solution chamber and the feeding conduit, the polymer layer containing a polymer prepared by polymerizing a silane coupling agent having a fluorine containing alkyl group.

16 Claims, 4 Drawing Sheets

COATING APPARATUS

FIELD OF THE INVENTION

The present invention relates to a coating apparatus employing a die of a flow rate regulating type, and in particular, to a coating apparatus wherein occurrence of a streak defect and others can be controlled and a stable coating ability can be obtained.

BACKGROUND OF THE INVENTION

A coating apparatus having therein a die of a flow rate regulating type, such as, for example, a slide hopper type coater or an extrusion hopper type coater is capable of coating a thin layer at speed on a simultaneous multi-layer basis, and is used widely, for its distinctive feature, as a coating apparatus for photographic light-sensitive materials and magnetic recording materials. In a coater of this type, a reservoired coating solution called a bead is formed between a tip of the coating apparatus (it is also called just a lip) and a running flexible support (it is also called a web), and coating is conducted through this bead.

FIG. 2 is a sectional view of an example of a slide hopper coating apparatus which is capable of coating two layers simultaneously. A material of a die is stainless steel generally (SUS304, SUS316, PSL (made by Hitachi Kinzoku Co.). In the drawing, a plurality of coating solutions 10 (for example, a gelatin solution for a protective layer) and 11 (for example, an emulsion solution for a photographic light-sensitive material) pass through coating solution chamber 3 and slit 2 both extending in the lateral direction, and then arrive at sliding surface 5 where the coating solutions flow down to arrive at tip of coating apparatus (lip) 1 to be coated there on web 7 that is running while being held by backup roll 6 as coated layer 12, through a reservoired solution called bead 9. In the drawing, pressure reducing device 8 is one which improves stability of a bead by pulling the bead down. Incidentally, a backup roll and other web-transport rolls are sometimes of a non-contact air floating type.

In the so-called bead coater as one described above, the stability of a bead is very important for stable coating. The stability of a bead is affected to a great extent by a gap that is set between a lip and a web, environmental conditions and physical properties of a coating solution (viscosity, surface tension and, especially the relation between layers in terms of physical properties in the case of simultaneous multi-layer coating). When the coating speed is further enhanced and a coated layer thickness is further reduced, it becomes difficult to keep a bead to be stable. When the bead is unstable, there occurs coating defect such as streak defect and solution-break defect, resulting in production loss.

FIG. 3 is an enlarged drawing of a portion of a bead in a slide hopper coating apparatus. In the drawing, coating solutions 10 and 11 which flow down along the slide surface 5 while being superposed each other form bead 9 between lip 1 that is a tip of the slide surface and web 7. In the case of a die made of metal or the like as one described above, the surface of the die is wetted very easily, and therefore, the bead enters lip surface 13 (shown with a dotted line in FIG. 3) that faces web 7 while being affected by coating conditions and external disturbance to the bead. Accordingly, the bead tends to be disturbed in the direction of a coating width, resulting in occurrence of a problem of streak-shaped coating defect (bead streaks).

Further, there has been a problem that foreign materials in a coating solution stick to the inner surface of coating solution chamber 3 or slit 2, thus, coagulated materials are produced, resulting in occurrence of a problem of streak-shaped coating defect (slit streaks).

The foregoing also comes under all kinds of bead coaters such as an extrusion coating apparatus and others, in addition to the aforesaid slide hopper coating apparatus.

Further, the foregoing can apply also to a curtain coater. In the curtain coater, a coating solution flows down in a shape of a curtain, without forming a bead, and hits a web to form a coated layer on the web. A tip portion of the coating apparatus takes various forms, and in the case of an extrusion type, for example, a coating solution oozes out and spreads on the lip surface and on the inclined surface following the lip, and it disturbs a solution at a portion where the coating solution at an outlet of the slit separates, to cause a streak defect on a flowing down layer. Further, the conditions of the slit and coating solution chamber are similar to those of a bead coater, and therefore, the slit streaks like the foregoing are also generated in a curtain coater.

As a method to eliminate occurrence of such streaks, there has been a method with regard to bead streaks, for example, to eliminate instability of a bead by treating a metal on the coater tip portion so that the metal may repel water and thereby by fixing the bead position using the water-repelling effect. For example,. Japanese Patent Publication Open to Public Inspection (hereinafter referred to as Japanese Patent O.P.I. Publication) No. 189963/1984 discloses a method wherein water-repelling resin parts such as polytetrafluoroethylene (Teflon =, made by DuPont Inc.) or the like are embedded, and Japanese Patent O,P.I. Publication No. 261330/1993 discloses a method wherein a layer containing fluorine-contained resins is formed through electroless nickel plating.

However, as a result of recent pursuit of high productivity, coating itself is required to be under severe conditions. Namely, the coater lip portion is required to be in dimensional accuracy of several $\mu$m class which is also required to be uniform in lateral direction for coating (for example, dimension variation of 100 $\mu$m or less per 1 m in the lateral direction for coating). The coater lip portion is also required to have mechanical strength, water-repelling effects of the coater lip is required to be maintained for a long time from the viewpoint of maintenance, and a method for that maintenance is also required to be simple. Thus, it has been difficult for the methods disclosed in Japanese Patent O.P.I. Publication No. 189963/1984 and in Japanese Patent O.P.I. Publication No. 261330/1993 to satisfy the all requirements mentioned above.

Namely, in the method to provide processing for donating water-repelling resin such as Teflon to a lip portion in Japanese Patent O.P.I. Publication No. 189963/1984, water-repelling effect is excellent. However, it is not possible to attain the above-mentioned accuracy required for a lip, and it is difficult to maintain the accuracy without damaging it. Further, in its maintenance, complicated processing needs to be done again, which is not simple. Therefore, the method is not practical at this stage. In the method to provide water-repelling processing through electroless nickel plating of fluorine-contained resin to the lip portion in Japanese Patent O.P.I. Publication No. 261330/1993, the life of water-repelling effect is so short as to reduce the water-repelling effect in the coating for a long time due to an influence of lack of fluorine-contained resin in a plated layer, keeping the water-repelling effect for a long time is difficult, the processing is plating processing requiring equipment in large scale, and its maintenance requests the plating processing in large scale to be conducted again, which is not simple, although the accuracy required as a lip mentioned above can be satisfied. Therefore, this method is not also practical at this stage.

With regard to slit streaks, an inside of a slit and a coating solution chamber has only to be treated to be water-repelling as in the foregoing because water-repelling effect can bring about a controlling effect for foreign material sticking simultaneously. However, in the method mentioned above, all conditions of the dimensional accuracy, mechanical strength and simple method described above can not always be satisfied just like the case of bead streaks, which has been a problem.

SUMMARY OF THE INVENTION

An object of the present invention is to solve the problems in prior art mentioned above, and further concrete object of the invention is to provide a coating apparatus provided with water-repelling processing satisfying all of the following requirements.

(1) To be excellent in mechanical strength (2) Dimensional accuracy is to be satisfied.

(3) A water-repelling effect is to be maintained for a long time.

(4) A donating method and a maintenance method are to be simple.

The object of the invention mentioned above can be attained by the following items.

Item 1: A coating die for coating a web with a solution, wherein the web is conveyed in a predetermined direction so as to run in the vicinity of the coating die; comprising;

a body forming the coating die, a coating surface provided on the body at a position close to the running web;

a solution chamber provided in the body;

a feeding conduit provided in the body, wherein the solution is fed from the outside of the body to the solution chamber through the feeding conduit;

a slit provided in the body so as to connect the solution chamber and the coating surface, wherein the solution is fed from the solution chamber to the coating surface through the slit, and then the solution is transferred from the coating surface to the running web;

a dry surface provided on the body and positioned upstream of the coating surface in terms of the web-running direction; and a polymer layer formed on at least one of (1) the dry surface, (2) an internal surface of the slit, and (3) internal surfaces of the solution chamber and the feeding conduit, the polymer layer containing a polymer prepared by polymerizing a silane coupling agent having a fluorine containing alkyl group.

Item 2: The coating die of item 1, wherein the coating die is a slide hopper type coater having a slide surface and a lip surface.

Item 3: The coating die of item 2, wherein the slide surface is used as the coating surface and the lip surface is used as the dry surface.

Item 4: The coating die of item 3, wherein a neighboring part of the slide surface adjoining the dry surface is provided with the polymer layer.

Item 5: The coating die of item 2, wherein, when the slide hopper type coater is employed as a curtain coater, the slide surface and the lip surface are used as the coating surface and a back surface of the lip surface is used as the dry surface.

Item 6: The coating die of item 1, wherein the coating die is an extrusion type coater having a upstream lip surface provided upstream of the slit in terms of the web-running direction and a downstream lip surface provided downstream of the slit.

Item 7: The coating die of item 6, wherein the downstream lip surface is used as the coating surface and the upstream lip surface is used as the dry surface.

Item 8: The coating die of item 6, wherein the downstream lip surface and the upstream lip surface are used as the dry surface.

Item 9: The coating die of item 1, wherein a thickness of the polymer layer is not more than 10 nm.

Item 10: The coating die of item 1, wherein the polymer layer is formed by a spray coating.

Item 11: The coating die of item 10, wherein in the spray coating, the silane coupling agent is dissolved in a solvent so that a spray solution is formed, the spay solution containing the silane coupling agent is sprayed onto the surface of the coating die to be provided with the polymer layer and the silane coupling agent is polymerized on the surface.

Item 12: The coating die of item 11, wherein water is applied onto the spray solution sprayed on the surface.

Item 13: The coating die of item 11, wherein, after the spray solution is sprayed onto the surface of the coating die so as to form a coated layer, the coated layer is heated during the polymerization.

Item 14: The coating die of item 13, wherein a heating temperature is no less than 50° C.

Item 15: The coating die of item 13, wherein a heating temperature is 130° C. to 200° C.

Item 16: The coating die of item 11, wherein the surface of the coating die to be provided with the polymer layer is cleaned with a solvent before the spray solution is sprayed.

Item 17: The coating die of item 1, wherein said polymer layer has a structure shown in formula 1:

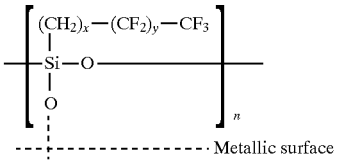

Formula 1 wherein, x and y each represents an integer of not less than 0 and n is a natural number.

Item 18: The coating apparatus of item 17, wherein a total number of said x and said y is 7 to 21.

Item 19: The coating apparatus of item 1, wherein said polymer layer is formed on (1) the dry surface, (2) the internal surface of the slit, and (3) the internal surfaces of the solution chamber and the feeding conduit.

[Explanation of Numerals]

Figure 1:
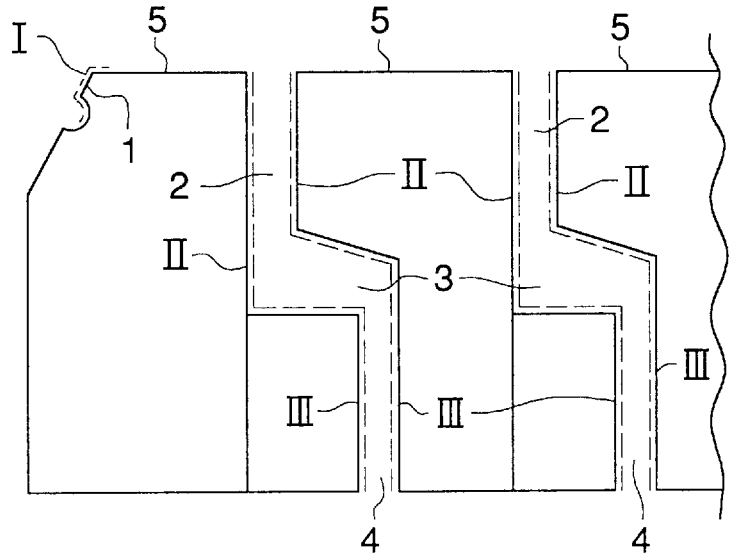
FIG. 1 is a sectional view of a portion to be subjected to the invention in a slide hopper coating apparatus.

1. Lip surface
2. Coating solution supply slit
3. Coating solution chamber
4. Feeding conduit
5. Slide surface
6. Backup roll
7. Web
8. Pressure reducing device
9. Bead
10. Upper layer coating solution (protective layer)
11. Lower layer coating solution (emulsion solution)
12. Coated layer
13. Lip surface
14. Silver iodobromide emulsion solution for silver halide photographic light-sensitive material used for lower layer coating solution
C. CCD camera
L. Light source
D. Wave-generating plate
E. Solution surface line
S. Stainless steel sample plate

DETAILED DESCRIPTION OF THE INVENTION

The invention will be explained concretely as follow.

In the invention, a water-repelling effect is achieved by forming a polymer layer containing a silane coupling agent having therein a carbon fluoride chain. Therefore, the dimensional accuracy and mechanical strength mentioned above can be maintained, a donating method and a maintenance method are simple, and it is possible to prevent streak defects while keeping water-repelling property for a long time. The invention will be explained concretely as follows, referring to the drawings.

In the present invention, the flowrate regulating type die means one that supplies only necessary coating amount.

The reason why a water-repelling silane coupling agent is coated on the tip portion of the die that comes close to a web is to prevent that a bead enters the lip surface from a solution-departing portion.

Figure 2:
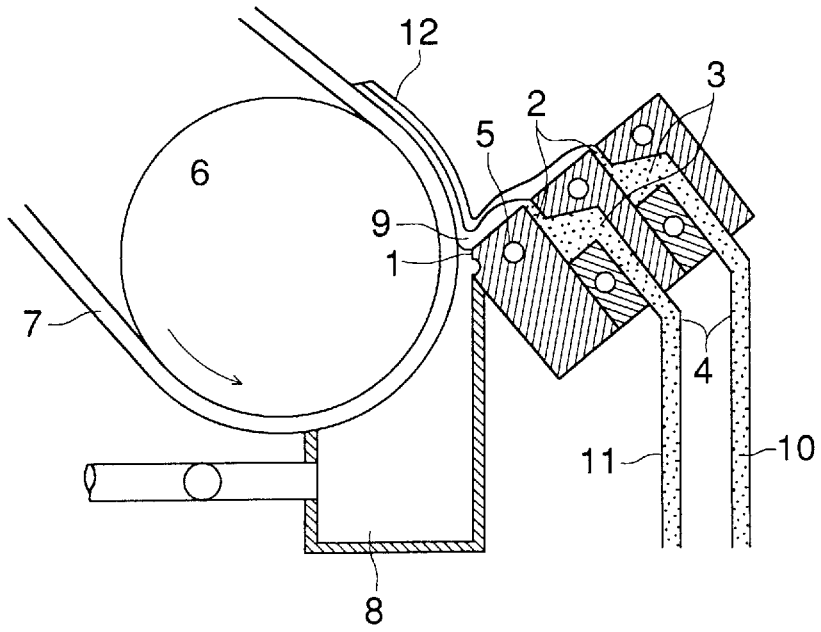
FIG. 2 is a sectional view of a slide hopper coating apparatus.
Figure 3:
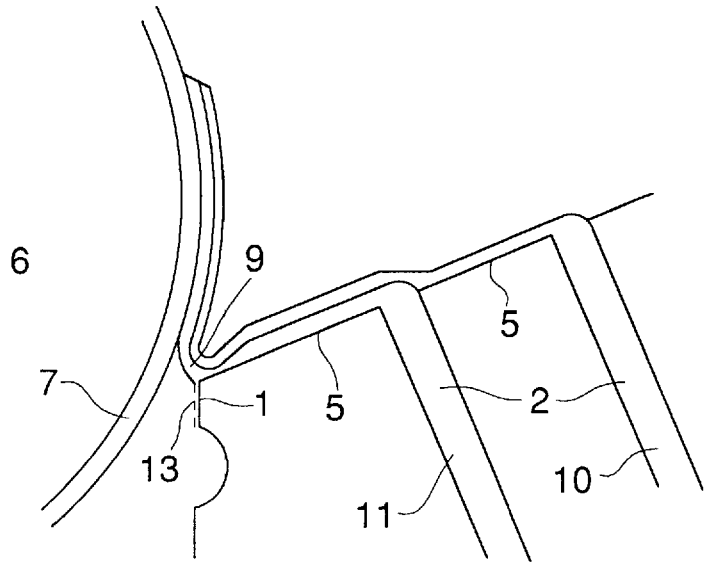
FIG. 3 is an enlarged view of a bead portion.

For example, when the silane coupling agent of the present invention or a polymer prepared by said silane coupling agent is not coated on the lip surface 1 in FIG. 1 or FIG. 2, it easily happens that the solution-departing portion of the coating solution enters the lip surface 1, and causes coating defects such as streak defects.

FIG. 1 is a sectional view of a portion to which the invention is applied in a slide hopper coating apparatus that is an embodiment example of the invention.

In FIG. 1, a polymer layer is formed on at least one of the following I through III portions, wherein the polymer layer containing a polymer prepared by polymerizing a silane coupling agent having a fluorine containing alkyl group, I portion shows a portion composed of a dry surface and a neighboring part of the slide surface 5 adjoining the dry surface, wherein, in FIG. 1, the lip surface 1 is employed as said dry surface, the slide surface 5 is employed as said coating surface and the lip surface 1 is positioned upstream of the coating surface in terms of the web-running direction and further, said neighboring part of the slide surface 5 adjoining the dry surface may be provided with the polymer layer, and II portion shows an internal surface of the slit 2, and III portion shows an internal surfaces of the coating solution chamber 3 and the feeding conduit 4.

A portion to which the processing mentioned above is to be applied includes a lip surface of a hopper in the case of "I" mentioned above, and it also includes a neighboring part of the slide surface 5 adjoining the lip surface as the dry surface. In the present invention, the phrase "a neighboring part of the slide surface 5 adjoining the lip surface" means the specific area having a width of 5 mm or less that is located on the slide surface 5 and adjoins the lip surface 1 directly in FIG. 1. It is more preferable that the width of the specific area is 2 mm or less.

In FIG. 1, portions indicated with dotted lines on a part of the lip surface 1 and the slide surface 5 can be subjected to water-repelling processing of the invention. In the case of "II" and "III" mentioned above, a part of the metallic surface can be subjected to water-repelling processing, but it is more preferable that the total metallic surface is subjected to water-repelling processing. In FIG. 1, surfaces shown with dotted lines on the slit 2 and the coating solution chamber 3 show the surface which can be subjected to water-repelling processing of the invention.

When considering a combination of each portion to be subjected to the above-mentioned processing, the aforesaid "I" alone is still effective for the streak defect caused by a bead, and "II" and/or "III" alone is also effective for streak defects generated from the inside of the slit or the coating solution chamber. Therefore, when considering that the causes of generation of streak defects are related to all of a bead, a slit and a coating solution chamber, it is preferable that all of three locations of "I", "II" and "III" are subjected to the processing although the processing for only one of them will do.

In FIG. 1, portions indicated with dotted lines on slit 2 or coating solution chamber 3 are the surfaces which can be subjected to water-repelling processing. As a combination of portions to be subjected to the processing, it is preferable that all of three locations "I", "II" and "III" are subjected to the processing, although the processing for any one of "I", "II" and "III" or any combination of "I" and "II", "I" and "III" and of "II" and "III" is effective.

Incidentally, in the preferable embodiment of the invention, a polymer layer containing a silane coupling agent that has aforesaid carbon fluoride chain is of the structure shown by Formula [I] mentioned above, and as a concrete example, for example, there will be given the following in Formula [1];

compound A: x=2, y=11 compound B: x=2, y=13

Incidentally, n in Formula [1] is a value determined by a size of the area processed. In the present invention, it is preferable that the total number of x and y is 7 to 21.

Methods for synthesizing compounds of the invention are described in "Surface improving agent having a carbon fluoride chain (written by Norio Yoshino)" in "Material Technology (edited by Material Technology Research Institute) Vol. 12, No. 3, 1994".

As a simple method for applying a compound represented by Formula [1] to a coating apparatus actually, there is, for example, a spray coating method. More specifically, the compound is a silane coupling agent, and the silane coupling agent is dissolved in a solvent to be a solution in advance, and this solution is sprayed directly on the surface to be processed by a spray gun (for example, chromato-spray). As the solvent, aromatic hydrocarbons such as benzene and a toluene, can be employed, and perfluoro alkanes are more preferably employed. Among of the above-mentioned, perfluorohexane is particularly preferably employed.

In the present invention, when perfluorohexane is employed as the solvent for coating, water-repelling capability of the coated surface shows an excellent result.

In preparing a coating solution having a silane coupling agent, the silane coupling agent is contained in an amount of 15 to 40 mmole/liter of the solvent, and preferably, of 25 to 30 mmole/liter of the solvent.

Furthermore, when the surface to be processed is cleaned with the solvent in an amount of at least 0.5 ml/l $cm^2$ of the processed surface before spraying, the coated surface show more improved result in water-repelling capability.

It is also preferable that the processing solution is spread evenly with a non-woven fabric cloth in the course of spraying. Further effect is brought about when the processed surface is wiped off with a non-woven fabric cloth moistened with pure water after spraying.

It is preferable that the processed surface is processed with pure water in an amount of at least 0.5 ml/1 $cm^2$ of the processed surface.

Judging from an excellent water-repelling capability of the processed surface obtained finally, it is considered that a dehydration condensation polymerization reaction of a silane coupling agent is accelerated by the processing of the processed surface with pure water.

The processed surface is subjected to heating processing totally after completion of the processing, so that more improved effect can be obtained, and the temperature of the heating processing is not less than 50° C., preferably, not less than 60° C., more preferably, 130° C. to 200° C., and particularly preferably, 150° C. to 170° C.

It is considered that the heat treatment step makes a silane coupling agent formed on the processed surface to form a uniform molecular layer which shows the excellent water-repelling capability.

A heating period is set to be at least not less than 3 minutes, preferably 30 minutes or more. This spray coating is just a method example to which the invention is not limited.

Advantages of the method mentioned above lie not only in its water-repelling effect and its continuity for a long time but also in simplicity of that method. The above-mentioned method can be executed in the air at normal temperature and normal humidity, and a large-sized processing equipment is not needed. With regard to total processing time, the above-mentioned spray coating method requires only about 3 hours in the case of an actual coating machine used for production, compared with conventional methods in Japanese Patent O.P.I. Publication Nos. 189963/1984 and 261330/1993 which require several days. In addition, the water-repelling processing of the invention does not require grinder machining after the processing at all to be much simpler than the aforesaid conventional processing method. Its maintenance method is also much simpler than conventional re-processing, because the aforesaid spray coating method has only to be performed again.

It is preferable that a thickness of a polymer layer prepared through the water-repelling method of the invention is not more than 10 nm in terms of dimensional accuracy. The thickness of a water-repelling-processed layer containing compound B prepared through the aforesaid processing method was slightly less than 50 Å as a result of AFM (Atomic Force Microprobe) measurement.

As a coating solution to which the invention is applied, there are given a hydrophilic colloid layer solution for photographic light-sensitive materials (including an emulsion solution), a synthesized polymer solution, a solution containing magnetic powder, and a volatile solvent. As a support to which the invention is applied, there are given glass and metal as well as various supports for silver halide photographic light-sensitive material such as, for example, cellulose triacetate and polyethyleneterephthalate.

EXAMPLE

Effects of the invention will be exemplified as follows in examples to each of which the invention is applied concretely. The invention, however, is not limited to the examples.

Coating was conducted under the coating conditions mentioned below, by the use of a two-layer type slide hopper coating apparatus (made of SUS 316) as shown in FIG. 2. [A coating solution that easily causes streak defects especially was selected as a coating solution to be used.]

Coating solution

Lower layer: Silver iodobromide emulsion solution for silver halide photographic light-sensitive materials
Gelatin density=4.0%
Viscosity=15 cP Upper layer: Protective layer solution for silver halide photographic light-sensitive materials
Gelatin density=6.0%
Viscosity=10 cP Coating conditions Coating speed: 120 m/min.,
Coating decompression: −40 mmAg
Coating gap: 200 μm Coated layer thickness Lower layer 50 μm, Upper layer 20 μm Total 70 μm Coating apparatus A coating apparatus wherein the following various processings were provided to portions I, II and III shown in FIG. 1 was prepared to be used for coating.

Processing 1: No processing

Processing 2: Electroless nickel plating (according to the method described in Japanese Patent O.P.I. Publication No. 261330/1993)

Processing 3: Polytetra fluoroethylene coating (according to the method described in Japanese Patent O.P.I. Publication No. 189963/1984)

Processing 4: Polytetra fluoroethylene lining (gluing polytetra fluoroethylene through lining in place of coating in the method described in Japanese Patent O.P.I Publication No. 189963/1984)

Processing 5: compound A of the invention was coated by the above-mentioned spray coating method as follows.

A coating solution having silane coupling agent of compound A of 30 mmole/liter of perfluorohexane, is prepared, the lip surface 1 and the slide surface 5 are respectively washed by perfluorohexane in an amount of 1 ml/1 $cm^2$ of the lip surface 1 or the slide surface 5, and then, the coating solution is sprayed directly on the lip surface 1 and the slide surface 5 to be processed by chromato-spray.

Next, the coated surface of the lip surface land the slide surface 5 are processed with pure water in an amount of 1 ml/1 $cm^2$ of the coated surface, and the coated surface is heated at 150° C. for 30 minutes.

The coated layer thickness of the lip surface 1 and the slide surface 5 are measured by AFM (Atomic Force Microprobe), and the coated layer thickness of the lip surface is 5 nm and the coated layer thickness of the slide surface is 5 nm.

(Evaluation method)

Evaluation (1) Streak defect

Samples subjected to aforesaid coating were developed through processing for ordinary black and white silver halide photographic light-sensitive materials, and number of streaks was counted visually. The results were classified, to be evaluated, in the following ranks each representing the number of streaks per 10 cm in the direction perpendicular to the coating direction.

Rank A: No streak
Rank B: 1 streak
Rank C: 2–3 streaks
Rank D: 4–6 streaks
Rank E: 7–10 streaks
Rank F: 11 streaks or more Evaluation (2) Disturbed bead Coating was conducted by the use of a transparent backup roll made of acrylic resin provided with a small-sized CCD camera at the central portion on the inside thereof, and images of bead behaviors at the central portion in a coating width on the slide hopper die in the course of coating were picked up to evaluate disturbance visually.

Figure 4:
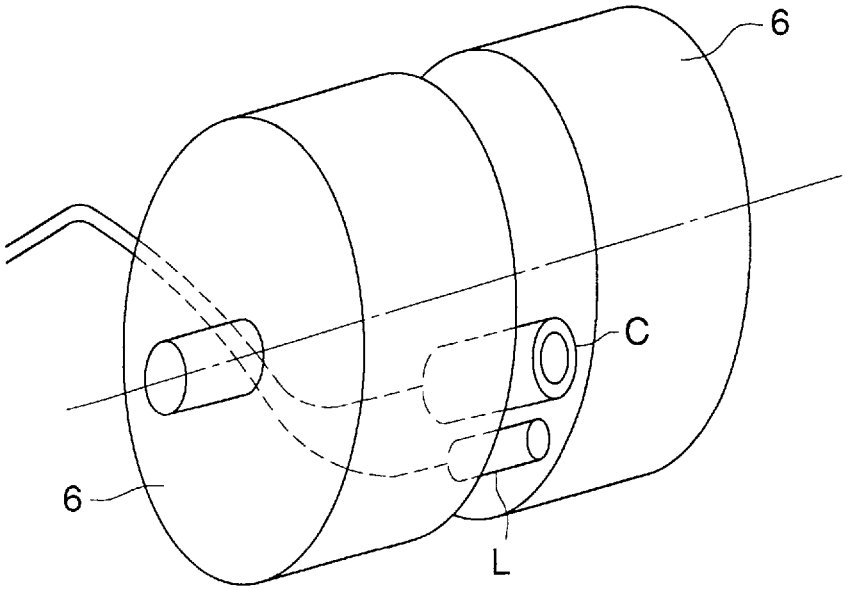
FIG. 4 is a perspective view showing how a CCD camera is installed.

FIG. 4 is a perspective view showing how the backup roll and CCD camera are installed in the occasion mentioned above.

Evaluation (3) Surface resistance

After using each coating apparatus ten-odd times actually, the surface, especially each portion where the lip surface adjoins the slide surface, was observed visually by the use of a magnifier. The results of the observation represented by deterioration such as damages were classified into ranks of the number of damages to be evaluated.

Rank A: No damage
Rank B: 1–2 damages
Rank C: 3–5 damages
Rank D: 6–10 damages
Rank E: 11 damages or more Incidentally, only Evaluation (1) was conducted through combination of 4 types of locations to be processed, namely, of only I, only II, only III and all of I, II and III in FIG. 1. For evaluations other than Evaluation (1), their processed portions were respectively I, II and III.

Further, with regard to those with the aforesaid Processings 1–5, the following measurement was conducted on an off-line basis to be added to the evaluation.

Evaluation (4) Water-repelling capability

In the room where adjusted temperature and humidity were 23° C. and 55 RH % respectively, a water drop in a prescribed amount was dropped on the stainless steel surface subjected to each of the Processings 1–5, and its side view was photographed through enlargement, and processed and printed. A droplet contact angle was measured by a protractor. Measurement was conducted at 5 points in the lateral direction of each sample, and an average value of 3 points excluding the maximum and minimum values was obtained. The average value was evaluated through comparison.

Evaluation (5) Foreign matters sticking

Figure 5:
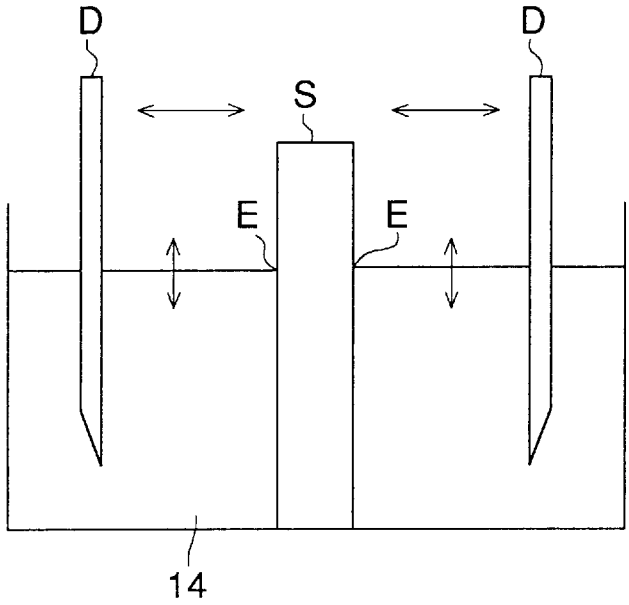
FIG. 5 is a sectional view of a wave-generating device.
Figure 6:
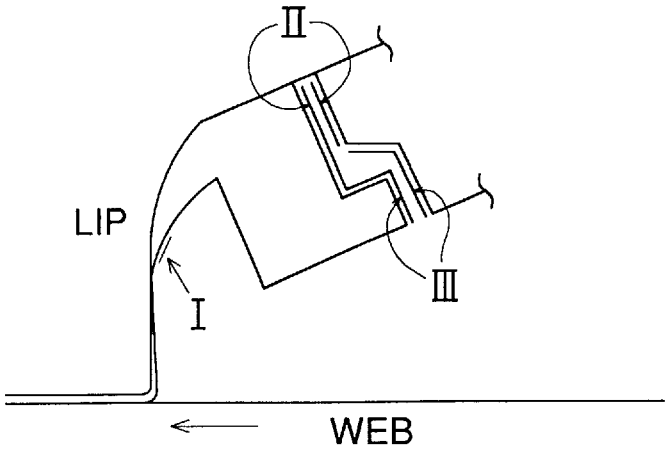
FIG. 6 is a sectional view of a portion to be subjected to the invention in a curtain coating apparatus as one kind of a slide hopper coating apparatus.
Figure 7:
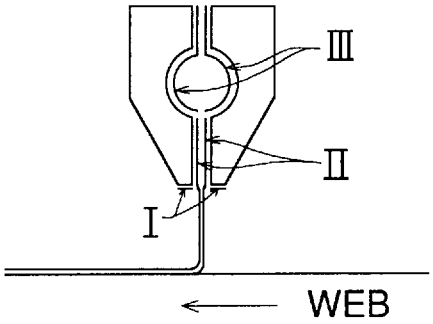
FIG. 7 is a sectional view of a portion to be subjected to the invention in a curtain coating apparatus as one kind of an extrusion coating apparatus.
Figure 8:
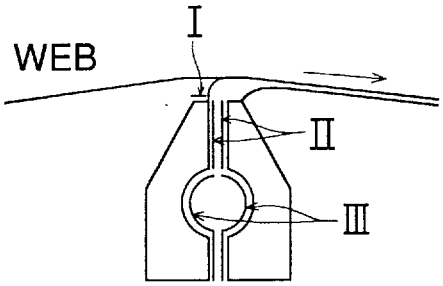
FIG. 8 is a sectional view of a portion to be subjected to the invention in an extrusion coating apparatus.

A certain amount of silver iodobromide emulsion solution 14 for silver halide photographic light-sensitive materials used as a lower layer coating solution in the aforesaid coating was poured in a wave-generating device as shown in FIG. 5, and each sample plate S subjected to each of the Processings 1–5 was dipped in the device. Then, wave-generating plate D was moved from side to side in the device for a certain period of time (6 hours in the present example) so that solution surface line E on each sample plate may be moved vertically by waves generated on the solution surface. Then, the number of emulsion coating solution layers which are generated to be large enough to be visible was counted visually, and it was classified for evaluation into ranks of the number of generated layers per a unit length (5 cm in the present example) of the solution surface line.

Rank A: No layer generation
Rank B: 1–2 locations of layer generation
Rank C: 3–5 locations of layer generation
Rank D: 6–10 locations of layer generation
Rank E: 11 or more locations of layer generation

TABLE 1

Results of Evaluation (1)

| Location of processing Contents | | I only | II only | III only | I, II and III |
|---|---|---|---|---|---|
| Comparative 1 | Processing 1 | F | | | |
| Comparative 2 | Processing 2 | C | D | D | C |
| Comparative 3 | Processing 3 | E | F | F | D |
| Comparative 4 | Processing 4 | D | E | E | D |
| Present invention | Processing 5 | B | B | B | A |

TABLE 2

Results of various evaluations

| | | Evaluation (2) | Evaluation (3) | Evaluation (4) | Evaluation (5) |
|---|---|---|---|---|---|
| Comparative 1 | Processing 1 | Yes | A | 70.5° | E |
| Comparative 2 | Processing 2 | Yes | A | 98.7° | C |
| Comparative 3 | Processing 3 | Yes | E | 110.2° | D |
| Comparative 4 | Processing 4 | Yes | D | 111.4° | B |
| Present invention | Processing 5 | No | A | 118.3° | A |

Results of Table 1 and Table 2 tell that a coating apparatus subjected to the processing of the invention is excellent in terms of various evaluation items, and it satisfies all conditions.

What is claimed is:

1. A coating die for coating a web with a solution, wherein the web is conveyed in a predetermined direction so as to run past the coating die, said coating die comprising:

a body forming the coating die, a coating surface provided on the body at a position close to the running web;

a solution chamber provided in the body for containing the solution;

a feeding conduit provided in the body, wherein the solution is fed from the outside of the body to the solution chamber through the feeding conduit;

a slit provided in the body so as to connect the solution chamber and the coating surface, wherein the solution is fed from the solution chamber to the coating surface through the slit, and then the solution is transferred from the coating surface to the running web;

a dry surface provided on the body and positioned upstream of the coating surface in terms of the predetermined direction; and a polymer layer formed on a polymer layer forming surface, the polymer layer forming surface being at least one of (1) the dry surface, (2) an internal surface of the slit, or (3) internal surfaces of the solution chamber and the feeding conduit, the polymer layer containing a polymer prepared by polymerizing a silane coupling agent having a fluorine containing alkyl group.

2. The coating die of claim 1, wherein the coating die is a slide hopper coater having a slide surface and a lip surface, and the slide surface is used as the coating surface and the lip surface is used as the dry surface.

3. The coating die of claim 2, wherein a neighboring part of the slide surface adjoining the lip surface and having a width of 5 mm or less is provided with the polymer layer.

4. The coating die of claim 1, wherein, the coating die is a curtain coater, said curtain coater having a slide surface and a lip surface having two oppositely facing sides with one side being a back surface which is used as the dry surface and the other side which is used as a coating surface.

5. The coating die of claim 1, wherein the coating die is an extrusion coater having an upstream lip surface provided upstream of the slit in terms of the predetermined direction and a downstream lip surface provided downstream of the slit, and the downstream lip surface is used as the coating surface and the upstream lip surface is used as the dry surface.

6. The coating die of claim 1, wherein the coating die is an extrusion coater having an upstream lip surface provided upstream of the slit in terms of the predetermined direction and a downstream lip surface provided downstream of the slit, and the downstream lip surface and the upstream lip surface are used as the dry surface.

7. The coating die of claim 1, wherein a thickness of the polymer layer is not more than 10 nm.

8. The coating die of claim 1, wherein the polymer layer is formed by a spray coating.

9. The coating die of claim 8, wherein in the spray coating, the silane coupling agent is dissolved in a solvent so that a spray solution is formed, the spray solution containing the silane coupling agent is sprayed onto the polymer layer forming surface of the coating die to form a coating layer and the silane coupling agent is polymerized on the polymer layer forming surface to form polymer surface.

10. The coating die of claim 9, wherein water is applied onto the coating layer.

11. The coating die of claim 9, wherein, after the spray solution is sprayed onto the polymer layer forming surface of the coating die so as to form the coated layer, the coated layer is heated during the polymerization.

12. The coating die of claim 11, wherein the coating layer is heated to a heating temperature which is no less than 50° C.

13. The coating die of claim 11, wherein the coating layer is heated to a heating temperature which is 130° C. to 200° C.

14. The coating die of claim 9, wherein the polymer layer forming surface of the coating die is cleaned with a solvent before the spray solution is sprayed.

15. The coating die of claim 1, wherein said polymer layer has a structure shown in formula 1:

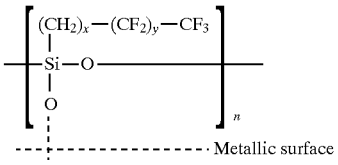

Formula 1 wherein, x and y each represents an integer of not less than 0 and n is a natural number and the total of x and y is 7 to 21.

16. The coating apparatus of claim 1, wherein said polymer layer forming surface is (1) the dry surface, (2) the internal surface of the slit, and (3) the internal surfaces of the solution chamber and the feeding conduit.

* * * * *